US006682268B2

(12) United States Patent
Robertson, Jr. et al.

(10) Patent No.: US 6,682,268 B2
(45) Date of Patent: Jan. 27, 2004

(54) METHOD AND APPARATUS FOR SECONDARY ROOF SUPPORT IN AN UNDERGROUND MINE

(75) Inventors: Roy Lee Robertson, Jr., Delbarton, WV (US); James Earl, Jr., Proctorville, OH (US)

(73) Assignee: Earl Products, Inc., Proctorville, OH (US)

( * ) Notice: Subject to any disclaimer, the term of this patent is extended or adjusted under 35 U.S.C. 154(b) by 0 days.

(21) Appl. No.: 09/944,666

(22) Filed: Aug. 31, 2001

(65) Prior Publication Data

US 2002/0028113 A1 Mar. 7, 2002

Related U.S. Application Data

(60) Provisional application No. 60/230,244, filed on Sep. 1, 2000.

(51) Int. Cl.[7] ..... E21D 21/00

(52) U.S. Cl. ..... 405/259.1; 411/531

(58) Field of Search ..... 405/259.1, 272, 405/288, 302.1; 411/531

(56) References Cited

U.S. PATENT DOCUMENTS

| | | | | | |
|---|---|---|---|---|---|
| 2,850,937 | A | * | 9/1958 | Ralston | 405/259.1 |
| 2,854,824 | A | * | 10/1958 | Curry et al. | 405/259.1 |
| 2,957,663 | A | * | 10/1960 | Marshall et al. | 405/259.1 |
| 3,090,203 | A | * | 5/1963 | Durget | 405/259.1 |
| 3,224,202 | A | * | 12/1965 | Durget | 405/259.1 |
| 3,415,064 | A | * | 12/1968 | Talobre | 405/259.1 |
| 3,464,308 | A | * | 9/1969 | Dohmeier | 405/259.1 |
| 3,478,523 | A | * | 11/1969 | Reusser et al. | 405/259.1 |
| 4,293,243 | A | * | 10/1981 | Graybeal et al. | 405/259.1 |
| 4,371,293 | A | * | 2/1983 | Wilcox et al. | 405/259.1 |
| 4,564,315 | A | | 1/1986 | Rozanc | |
| 4,627,207 | A | * | 12/1986 | Young et al. | 411/531 |
| 4,704,053 | A | | 11/1987 | Hipkins, Sr. | |
| 4,708,559 | A | * | 11/1987 | Locotos | 411/531 |
| 4,773,490 | A | | 9/1988 | McSweeney et al. | |
| 4,780,039 | A | * | 10/1988 | Hartman | 411/531 |
| 4,784,530 | A | | 11/1988 | Price, Jr. | |
| 5,042,961 | A | | 8/1991 | Scott et al. | |
| 5,064,311 | A | | 11/1991 | Giroux et al. | |
| 5,143,484 | A | | 9/1992 | Deul | |
| 5,259,703 | A | | 11/1993 | Gillespie | |
| 5,273,377 | A | | 12/1993 | Taylor | |
| 5,417,520 | A | | 5/1995 | Rastall | |
| 5,462,391 | A | | 10/1995 | Castle et al. | |
| 5,511,909 | A | | 4/1996 | Calandra, Jr. | |
| 5,544,982 | A | | 8/1996 | Seegmiller | |
| 5,556,234 | A | * | 9/1996 | Oldsen et al. | 405/259.1 |
| 5,584,611 | A | | 12/1996 | Clonch | |
| 5,628,587 | A | * | 5/1997 | Lesslie | 405/302.1 |
| 5,733,069 | A | | 3/1998 | Schofield, Jr. | |
| 5,791,828 | A | * | 8/1998 | Fergusson | 405/302.1 |
| RE35,902 | E | | 9/1998 | Calandra, Jr. | |
| 5,967,703 | A | | 10/1999 | Stankus et al. | |
| 6,039,509 | A | | 3/2000 | Locotos | |

* cited by examiner

*Primary Examiner*—Thomas B. Will
*Assistant Examiner*—Alexandra K. Pechhold
(74) *Attorney, Agent, or Firm*—Robert B. Waters; Waters Law Office PLLC

(57) ABSTRACT

A method for providing secondary roof support in an underground mine such as to reduce the hazard of localized crumbling or deterioration of a mine roof. The apparatus generally comprises a slightly convex steel plate, crafted to cradle a roof bolt and which is supported by the base plate of the primary roof control system. The apparatus is utilized with standard primary roof bolt systems. By applying an upward pressure on the roof and effecting a larger coverage area for each roof bolt, the opportunity for drawrock separation to begin is reduced, and the exposure of the elements to drawrock strata in the vicinity of the bolt is eliminated. The method includes the step of utilizing the apparatus, with convex portion of the lateral plate facing upwards, before the placement of the base plate and roof bolt.

4 Claims, 2 Drawing Sheets

METHOD AND APPARATUS FOR SECONDARY ROOF SUPPORT IN AN UNDERGROUND MINE

CROSS REFERENCE TO RELATED APPLICATIONS

This application claims priority from U.S. provisional application No. 60/230,244, filed on Sep. 1, 2000. This application relates to a method and apparatus for providing secondary support for roof control in underground mines. The entire disclosure contained in U.S. provisional application No. 60/230,244, including the attachments thereto, is incorporated herein by reference.

STATEMENT REGARDING FEDERALLY SPONSORED RESEARCH OR DEVELOPMENT

Not Applicable

BACKGROUND OF THE INVENTION

In an underground mine, providing and maintaining adequate support for the mine roof is of paramount importance. The majority of serious or fatal accidents occurring in underground mines in the United States over the years have resulted from an inability to control the roof of the mine. While accidents involving major cave-ins of mine roofs have become less prevalent over the years, it is important to note that a fatal accident can occur from the falling of even one large rock from the roof of a mine. Accordingly, mine roof control systems must be completely effective in order to provide safety for personnel working in the mines. The Mine Safety and Health Administration (MSHA) is empowered by the United States government to enforce mine safety standards, including roof support standards, and to provide inspection of mine roof control plans and practices carried out in the mining industry.

As a result of greater emphasis on safety and roof support, serious accidents involving major roof cave-ins have decreased substantially since the 1970s. In order to comply with MSHA standards, underground mines must have a roof control plan in place, and such plan will invariably include provisions for what is known as "primary roof support." Primary roof support refers to abatement provisions designed to prevent a roof cave-in by effectively sealing the lowest layers of a mine roof to upper strata of rock. The most common and effective means for attaching lower level rock strata to upper layers is to utilize a roof bolt and epoxy resin to seal the various layers of rock strata. Roof bolts vary in length and size but are typically one-half inch or more in diameter and 30 inches to 12 feet long or longer in overall length. To place a roof bolt in a roof ceiling, a motorized roof bolter, such as that manufactured commercially by such companies as Fletcher Mining Equipment Company, is positioned in the front, unprotected face of the mine and features a drilling mechanism to drill several feet up through the mine roof. After a hole is placed in the roof, an epoxy resin in a pliable plastic tube is inserted in the hole. Next, a roof bolt is placed in the hole, and the placing of the roof bolt tears the packaging for the epoxy resin and mixes said resin to the bolt itself and the surrounding rock layers. The epoxy resin typically "sets up" or hardens within a matter of seconds and the bolt and rock layers are thereby sealed to each other.

In most underground mining situations, a roof bolt is placed approximately every four feet in the mine. Accordingly, placement of roof support is a major undertaking and a major source of expense for the mine operator. Despite the cost, roof bolt/epoxy combinations are the most effective and practical means for providing primary roof support, and fully meet the requirements promulgated by MSHA and various state enforcement authorities.

Although methods for providing primary roof support have become increasingly effective over the years, another problem frequently encountered in underground mining is the problem associated with "drawrock." Drawrock refers to thin layers of shale, one inch to twenty inches thick, which is frequently found in some parts of the United States and around the world immediately adjacent and above seams of coal. In such scenarios, as coal is mined, the immediate roof material may consist of several inches or feet of shale or drawrock.

Shale is typically very hard in the compressed state, and a mine roof characterized by shale usually is a very stable roof when the mine is first opened and the adjoining seam of coal first removed. However, when shale is exposed to the elements, i.e. moisture, the characteristics of the rock begin to change. Over a period of time, wet shale will begin to deteriorate into drawrock, and the layers of rock will separate. As this occurs, the lower, exposed layers will crumble and begin flaking off and dropping. It is quite typical that the inside of an underground mine will be wet, and often a substantial amount of water will be encountered. Accordingly, drawrock can be a major problem in a wet underground mine which is characterized by a shale roof or upper walls. While primary roof control is quite effective in securing various strata of rock together for three to six foot lengths, primary roof support does not address the problem of drawrock.

In the past, various methods have been utilized by mine operators to control drawrock or other loose material in the immediate roof layer. One method is to use wooden members, referred to as "half-headers" to extend laterally across a portion of a mine opening. Half-headers provide a limited amount of support for drawrock, but are not especially useful because the amount of surface area protected by a half-header is relatively small. In addition, half-headers are bulky and extremely difficult to use. Hauling wooden members into a mine site and locating them at areas where lateral support is needed is extremely expensive and difficult.

Another method for controlling loose material in the immediate roof layer is to use a continuous ribbon system, which has been commercialized since at least the 1970s. In essence, this method involves a steel ribbon six or more inches wide held against the roof by means of the roof bolt used for primary support. In theory, the ribbon serves to attach each roof bolt in a particular line and hold any loose material located between the roof bolts. However, this system features a number of significant drawbacks, including the fact that such steel ribbons are extremely difficult and costly to install. Furthermore, since the ribbon is straight, it is only possible to utilize such method between a series of roof bolts if, in fact, the roof bolts are reasonably well aligned in a straight line with respect to each other. To the extent that some roof bolts are not exactly spaced in line with the previous bolt four foot earlier, the ribbon will not fit. Furthermore, the usefulness of this method is compromised when the surface of the mine roof is not uniform. If, as is usually the case, the mine roof is characterized by pits or sudden changes in lateral height, the ribbon may not, in fact, be resting against said roof. As a result, the ribbon is not providing protection against loose drawrock in such areas. In addition, even when installed properly, the ribbon does not provide upward pressure to the drawrock to prevent it from beginning to separate.

Another method occasionally utilized in an underground mine is the use of a screen assembly mounted against the mine roof, such as to restrain and collect drawrock or other material that becomes loose. The screens typically feature a two-inch by two-inch grid, somewhat similar to a chain link fence, and is attached to the mine roof by means of the roof bolts used for primary support and/or other attachment devices and bolts. Screen assemblies are very effective at controlling drawrock, but pose the distinct disadvantage of being very expensive and difficult to install. Essentially, an installation of a screen is analogous to the installation of a permanent steel roof throughout a mineshaft and the expensive nature of that undertaking can easily be the difference between a profitable mine and a mine which the owner cannot afford to operate. Moreover, when such a screen is in place, once enough rock falls on top of the screen, it begins to sag from the weight, creating a new hazard.

SUMMARY OF THE INVENTION

The objective of this invention is to provide an improved method and device for providing secondary roof support in an underground mine such as to reduce the hazards of localized crumbling or deterioration of a mine roof. In order to attain this objective, the present invention generally comprises a slightly concave steel plate, a standard primary roof bolt, and a methodology for arranging said elements to provide secondary mine roof support. By applying an upward pressure on the roof and effecting a larger coverage area for each roof bolt, the opportunity for drawrock separation to begin is reduced.

Another primary objective of the present invention is to provide a secondary mine roof support system that is durable enough to withstand physical pressure as well as environmental challenges such as moisture, including acidic moisture, dust, and heavy equipment access.

Yet another objective of this invention is to create a device for secondary mine roof support which is inexpensive to manufacture, inexpensive to install, and increases the life expectancy of secondary mine support members. In addition, a further objective of the invention is to create a secondary mine support system that does not require frequent maintenance or replacement of component parts. Specifically, it is desired that the apparatus disclosed in this invention should have a life expectancy in excess of fifteen years.

Another objective of this invention is to provide a device that protects the integrity of the primary roof support system. Once drawrock falls from around the bearing plate, this area of the mine has a much reduced primary roof support. The present invention, by creating a greater contact area, helps minimize that hazard.

Another primary objective of the present invention is to provide an apparatus for secondary mine roof support that is easy to transport into location in the mine. Accordingly, this invention serves to reduce both the cost and personnel difficulty involved in transporting the device, such as to increase the likelihood that the device will be used by mine employees.

As discussed above, the method and device of the present invention overcomes the disadvantages inherent in prior art methods and devices. In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Accordingly, those skilled in the art will appreciate that the conception upon which this invention is based may readily be utilized as a basis for the design of other structures, methods, and systems for carrying out the several purposes of the present invention. It is important, therefore, that the claims be regarded as including such equivalent constructions insofar as they do not depart from the spirit of the present invention.

Furthermore, the purpose of the foregoing Abstract is to enable the U.S. Patent and Trademark Office and the public generally, and especially including the practitioners in the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any way.

BRIEF DESCRIPTION OF THE DRAWINGS

Additional utility and features of this invention will become more fully apparent to those skilled in the art by reference to the following drawings, wherein all components are designated by like numerals and described more specifically.

DETAILED DESCRIPTION OF THE INVENTION

Figure 1:
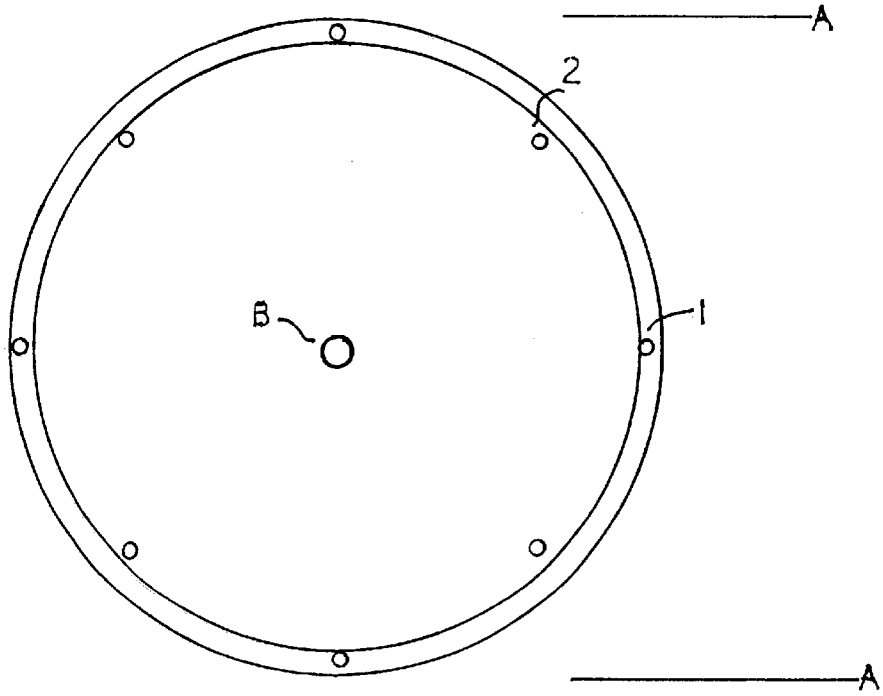
FIG. 1 is a plan view from the bottom, of the preferred embodiment of the secondary mine roof support member constructed in accordance with this invention.

FIG. 1 shows the secondary mine roof support member 100 of the present invention. The support member 100 is a one-piece design and can be constructed from a variety of materials, but is optimally constructed of 20 gauge cold rolled steel. As indicated in the drawing, the preferred embodiment is 19.5 inches in diameter, although other sizes are certainly possible.

Support member 100 is also characterized by an aperture 101 in the center of support member 100. Aperture 101 is preferably a three-quarter inch diameter aperture such as to accommodate the two most prevalent sizes of primary roof support bolts: three-quarter inch, and five-eighths inch. The preferred embodiment also included one or more weep holes 102 arranged along the periphery of the member, at approximately one inch from the edge. Weep holes 102 allow for moisture that collects from the enclosed roof area to be exhausted such that it does not build up such as to support rusting of the unit.

Figure 2:
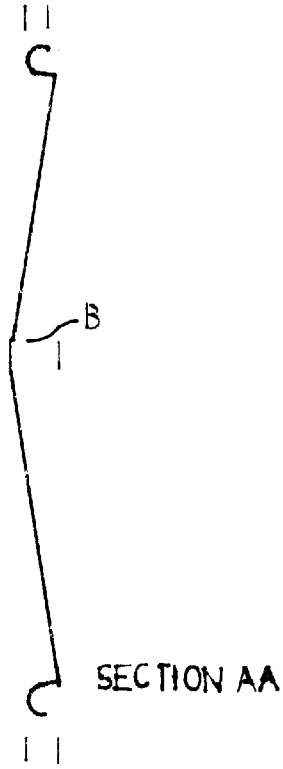
FIG. 2 is a side view of the preferred embodiment of the secondary mine roof support member constructed in accordance with this invention.

FIG. 2 shows a side view of the preferred embodiment taken along axis "AA" in FIG. 1. This diagram essentially shows the center deflection of support member 100 such that it is "bowed inward". In practice, this feature provides a measure of upward support or pressure by the support member such as to assist the primary roof support system in keeping the various rock strata tightly secured in the area of the roof bolt. The amount of upward support can be varied as a function of the grade and thickness of the support member as well as the degree of center deflection. As shown in FIG. 2, the optimum center deflection for the preferred embodiment is approximately 21/32 inches as noted.

Figure 3:
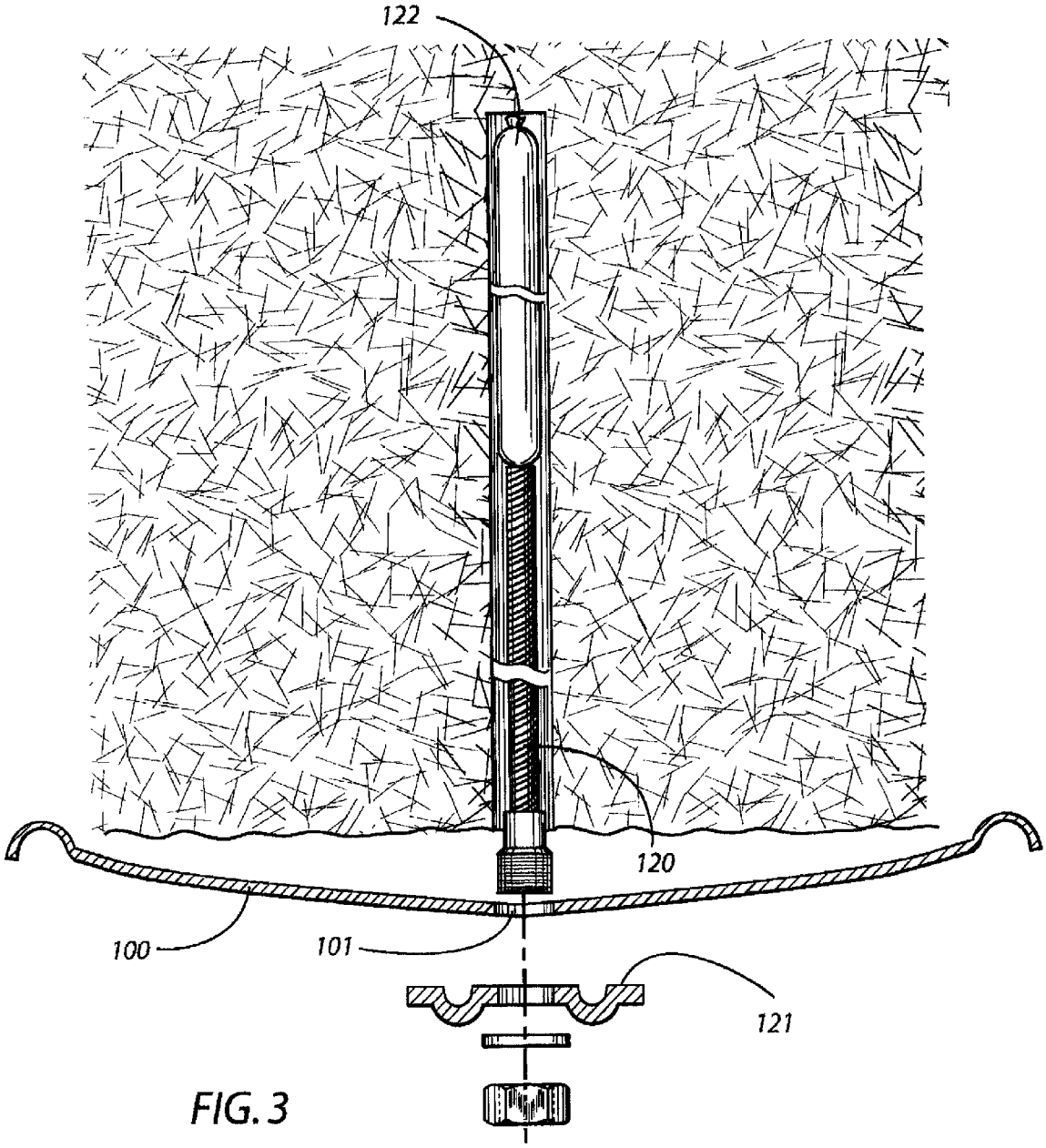
FIG. 3 is a side view showing the arrangement of the components as utilized in the practicing of the method of providing primary and secondary mine roof protection as set forth in the claimed method.

FIG. 3 is a side view that shows and describes the operation of the claimed method of the invention. As shown in the drawing, a hole is drilled into the roof of the mine through the rock strata a distance of generally four to twenty feet. Into such hole, a pre-fabricated conventional tube of epoxy sealant 122 is placed into the hole in the mine roof. Next, the roof bolt 120 is inserted as shown, and the roof bolt 120 is fully inserted through the hole in the rock strata, usually by a mechanical roof bolting apparatus. The insertion of the roof bolt 120 serves to tear the thin sheath surrounding the epoxy sealant, and the twisting of the roof bolt by the mechanized roof bolter serves to effectively mix the epoxy materials, the roof bolt and the rock strata to anchor the rock strata to the bolt. Since the epoxy sets up a hardened bond in several seconds, the system is secure.

Immediately after insertion of the roof bolt 120, the roof cap 100 is placed upon the end of the roof bolt 120. Next, base plate (also known as a bearing plate) 121 is placed upon the end of the roof bolt 120 and a nut or other attachment means is placed upon the end of the roof bolt and tightened. Upon tightening of the nut onto bolt 120, the roof cap 100 and base plate 121 will be placed into tension against the rock strata as a result of the radial edge 104 on the roof cap 100. This process provides tension at a radial location, removed from the bolt and helps prevent the accumulation of moisture in the vicinity of the base plate and adjacent to the drilled hole in the rock strata. By this method, the prevalence of draw rock is reduced.

We claim:

1. A method for providing primary and secondary roof support in an underground mine comprising the steps of:

a.) drilling a hole into the roof of the underground mine and into upper level rock strata;

b.) inserting a container of adhesive material into said hole;

c.) positioning a lateral support member featuring a plurality of weep holes disposed along the periphery of said lateral support member adjacent the roof of said underground mine centered over said hole;

d.) positioning a base plate adjacent said lateral support member; and e.) inserting a roof bolt through said base plate and said support member into said hole, the insertion of said roof bolt fracturing the container of adhesive material, thus allowing said adhesive material to be distributed around said roof bolt, securing said roof bolt in said hole and securing said base plate and support member to the roof of said underground mine for providing primary and secondary roof support.

2. The method of claim 1, wherein said lateral support member is substantially flat with a circular configuration in the general form of a plate.

3. The method of claim 2, wherein said lateral support member features a center deflection with respect to the radial edge of said support member such that said support member is slightly convex with respect to the mine roof surface.

4. The method of claim 1, wherein said lateral support member features a groove along the periphery of said support member.

* * * * *